US009333626B2

(12) United States Patent
Kim

(10) Patent No.: US 9,333,626 B2
(45) Date of Patent: May 10, 2016

(54) APPARATUS FOR FORMING SHOT BALL

(71) Applicant: Kyoung jo Kim, Busan (KR)

(72) Inventor: Kyoung jo Kim, Busan (KR)

( * ) Notice: Subject to any disclaimer, the term of this patent is extended or adjusted under 35 U.S.C. 154(b) by 0 days.

(21) Appl. No.: 14/808,240

(22) Filed: Jul. 24, 2015

(65) Prior Publication Data

US 2016/0039071 A1 Feb. 11, 2016

(30) Foreign Application Priority Data

Aug. 6, 2014 (KR) ..... 10-2014-0100826

(51) Int. Cl.

| | |
|---|---|
| ***F24B 7/04*** | (2006.01) |
| ***B24C 11/00*** | (2006.01) |
| ***B21F 1/00*** | (2006.01) |
| ***B24C 1/10*** | (2006.01) |
| ***B21K 1/02*** | (2006.01) |

(52) U.S. Cl.

CPC . *B24C 11/00* (2013.01); *B21F 1/00* (2013.01); *B21K 1/02* (2013.01); *B24C 1/10* (2013.01)

(58) Field of Classification Search

CPC ..... B24C 1/10; B24C 11/00; B21F 1/00; B21K 1/02

USPC ..... 72/426

See application file for complete search history.

(56) References Cited

U.S. PATENT DOCUMENTS

| | | | | | |
|---|---|---|---|---|---|
| RE23,538 | E * | 8/1952 | Hancox et al. | B22F 9/08 | 425/8 |
| 2,758,360 | A * | 8/1956 | Shetler | B21K 1/02 | 241/275 |
| 3,204,320 | A * | 9/1965 | Eckstein | B21K 1/02 | 29/898.069 |
| 4,402,884 | A * | 9/1983 | Koike | C22C 33/0207 | 264/8 |
| 5,950,469 | A * | 9/1999 | Tsuro | C21D 7/04 | 29/898.069 |
| 6,018,854 | A * | 2/2000 | Miyasaka | B22F 1/0085 | 29/899 |
| 8,567,298 | B2 * | 10/2013 | Pearson | F42B 7/046 | 102/448 |
| 2010/0322816 | A1 * | 12/2010 | Kobayashi | B24C 11/00 | 420/87 |

* cited by examiner

*Primary Examiner* — David B Jones

(74) *Attorney, Agent, or Firm* — Park & Associates IP Law, P.C.

(57) ABSTRACT

The present invention provides an apparatus for forming a shot that can prevent a loss of shot in the process of forming and sorting the shot balls and can collect dust in a cyclone type that can strongly suppress generation of dust.

7 Claims, 6 Drawing Sheets

APPARATUS FOR FORMING SHOT BALL

REFERENCE TO RELATED APPLICATIONS

This application claims the priority benefit of Korean Patent Application No. 10-2014-0100826 filed on Aug. 6, 2014, the entire contents of which are incorporated herein by reference.

FIELD OF THE INVENTION

The present invention relates to an apparatus for forming shot and, more particularly, to an apparatus for forming shot to be used in shot peening.

BACKGROUND OF THE INVENTION

Recently, various machining processes such as mechanical nontraditional machining, electric nontraditional machining, and chemical nontraditional machining have been studied in various ways to perform surface finishing on mechanical parts and increase their durability.

Examples of mechanical nontraditional machining include sandblasting and shot peening, both of which improve fatigue strength and surface hardness by generating work-hardening on the surface of a workpiece. In particular, shot peening can not only increase design ability by improving strength of a material, but maintain high toughness at the center portion of the material, so it is very useful for parts in a mechanical structure that receive fatigue loads, and is very important particularly for improving fatigue strength and lifespan.

In comparison to heat treatment or other machining methods, an advantage of shot peening is that it is possible to be performed without using a large energy source and thus pollution due to consumption of fuel is reduced. Further, strength increases after shot peening, so weight decreases, energy is saved, and air pollution is prevented.

Shot peening is used throughout industry including mechanical, aerial, automotive, shipbuilding, and civil engineering and construction fields, and particularly, the size, strength, and safety of products have been improved and the weight of products has been decreased with development of the technology, so shot peening is applied to various and wide fields.

Further, shot peening is particularly useful for increasing fatigue lifespan and fatigue strength of a coil spring, a leaf spring, a gear, a crankshaft, a connecting rod, an axle shaft, a universal joint, a piston, a cylinder block, a crank case, a torsion bar, a chain link, a milling cutter, a drill, a high-pressure steel pipe, a high-pressure container, jet engine blades, and blades of a helicopter. Furthermore, shot peening is useful for a notch of a part, a key groove, a welded portion, corrosion fatigue portion, a portion under high stress, a surface of a part after machining, a surface after grinding, a decarbonized portion after heat treatment, a friction portion, a distorted portion, and a surface after discharge machining.

Soft steel, hard steel, tooled steel, steel for a structures, spring steel, duralumin, an aluminum alloy, stainless steel, zinc, and emery are generally used for the material of shot balls.

Manufacturing methods for a steel shot ball include a casting method and a method that uses a cut wire, and both are used to create a stronger paint adhesion quality on a metal surface by making the metal surface rough using metallic particles like sand grains.

Shot and grit are types of shot peening balls generally used in industries using metal as a raw material, such as automotive, constructing, shipbuilding, forging, and steel industries, and are needed to satisfy various shapes and properties of metals. Accordingly, the inventor(s) has proposed a "Shaping apparatus for shot" and manufactured a shot in Korean Patent No. 10-0524536.

However, according to the shaping apparatus for shot, material is accumulated between projection sides in projection for rounding and there is a problem of inaccurate sorting and loss of shot in the process of sorting complete shot balls in accordance with diameters thereof.

Further, dust cannot be completely collected due to overload in the apparatus, so there is a need for an apparatus for forming shot equipped with a device that can strongly suppress generation of dust.

SUMMARY OF THE INVENTION

Accordingly, the present invention has been made keeping in mind the above problems occurring in the related art, and the present invention is intended to propose an apparatus for forming shot that can prevent a loss of shot in the process of forming and sorting shot balls and can collect dust using a cyclone type that strongly suppress generation of dust.

In order to achieve the above object, according to one aspect of the present invention, there is provided an apparatus for forming shot that includes: a tank for receiving cut-off pieces finely cut from a steel wire and dropping the cut-off pieces through a conveying channel formed at a side; a forming chamber disposed under the tank, communicating with the conveying channel, and including a projection side disposed on a first side therein and an impeller rounding cut-off pieces by projecting the cut-off pieces dropping through the conveying channel to the projection side using high-speed airflow; a conveyer having a first side disposed at a lower portion of the forming chamber and a second side communicating with an upper portion of the tank to convey cut-off pieces, which drop to the tank after hitting against the projection side; and a dust collector communicating with the forming chamber and collecting dust by absorbing dust and fragments produced in the forming chamber. The apparatus further includes a vibrator that is composed of: a supply channel formed at a second side of the tank and carries cut-off pieces that are finished being machined; a cylindrical body communicating with the supply channel at an upper portion and receiving cut-off pieces that drop; a plurality of insertion spaces formed with regular intervals in a depth direction of the body; sorting units separably inserted in the insertion spaces, respectively, and sorting cut-off pieces in accordance with diameters thereof; discharge ports formed between the insertion spaces to discharge the sorted cut-off pieces; and a vibrating unit disposed at a side of the body and vibrating the sorting units.

The projection side may be made of chrome steel and composed of a plurality of unit members spaced in a depth direction of the first side in the forming body, and anti-collection plates may be disposed in spaces between the unit members.

The dust collector may include: a cylindrical cyclone unit having an inverse conical lower portion; an inflow pipe connecting an upper portion of an outer side of the cyclone unit with the forming chamber; a storage communicating with a bottom of the cyclone unit and storing fragments turning and dropping along an inner side of the cyclone unit; and a discharge pipe communication with a top of the cyclone unit and discharging dust moved up in the cyclone unit.

The sorting units may each include a first rim separably inserted in a corresponding insertion space and a first filtering net disposed inside the first rim.

The vibrating unit may include: a vibration motor disposed under the body and vibrating the body up and down; and a plurality of springs disposed on a bottom of the body.

The sorting units may each include: a second rim separably inserted in a corresponding insertion space; a second filtering net disposed inside the second rim; rotational shafts connected with the second filtering net through both sides of the second rim; and fin stoppers formed at upper and lower portions of the second rim at an angle toward a center of the second rim.

The vibrating unit may include: driving motors coupled to predetermined rotational shafts and providing rotational vibration by turning the second filtering net forward and backward; and a bed supporting the driving motors.

According to the present invention, the following effects can be expected.

Since collection of shot in the apparatus in the forming process can be prevented, maintenance is simple and the maintenance cost can be reduced.

Since it is possible to prevent a loss of shot in the process of sorting and improve sorting performance, it is possible to increase production efficiency.

Since dust is collected in the cyclone type that strongly suppresses generation of dust, work environment is improved and work efficiency can be improved accordingly.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinafter, preferred embodiments of the present invention are described in detail with reference to the accompanying drawings.

Figure 1:
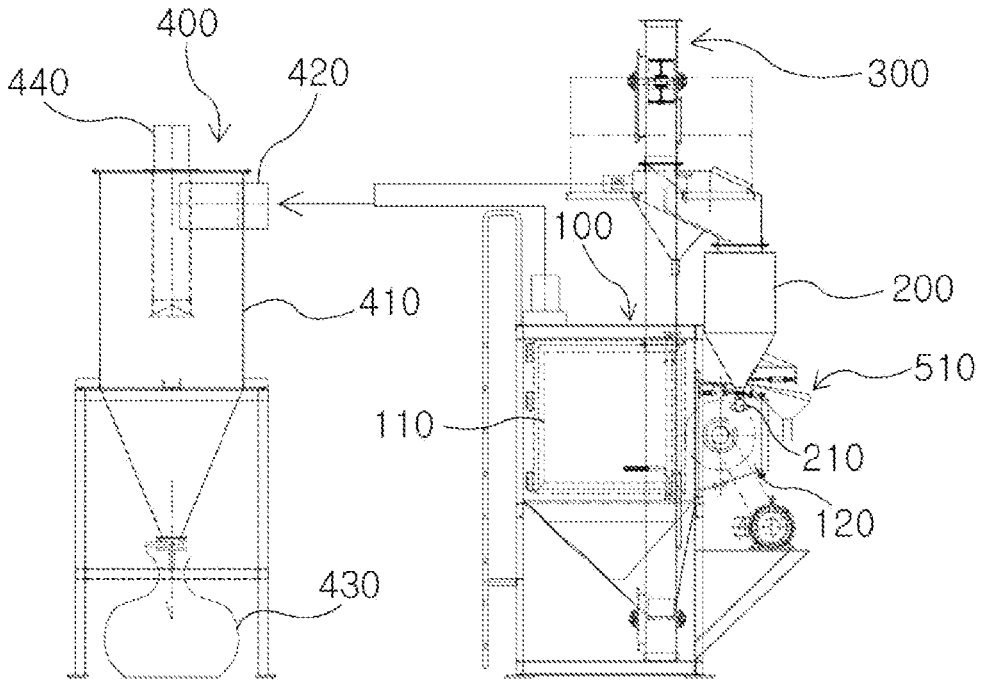
FIG. 1 is a view showing an apparatus for forming a shot according to an embodiment of the present invention.
Figure 3:
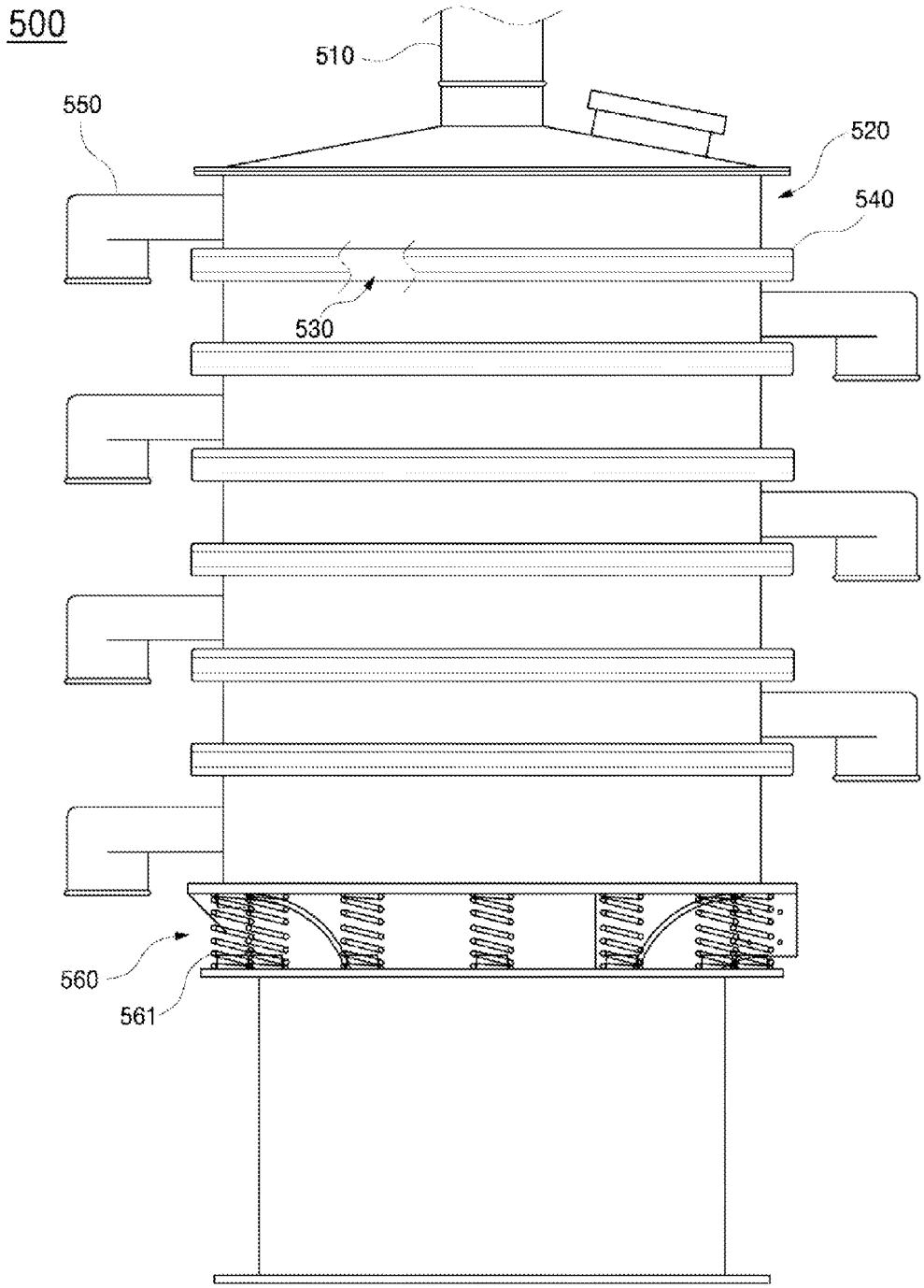
FIG. 3 is a view showing a first embodiment of a vibrator according to the present invention.

The present invention provides an apparatus for forming a shot (steel ball) used as a shot peening ball in peening or blasting by rounding a cut-off piece, which is finely cut from a steel wire, with high precision. As shown in FIG. 1 showing the apparatus for forming a shot and FIG. 3 showing a first embodiment of a vibrator according to the present invention, the apparatus includes a tank, a forming chamber, a conveyer 300, a dust collector 400, and a vibrator 500 that sorts cut-off pieces in accordance with diameters after forming.

The tank 200, which is formed in the shape of a hopper, receives cut-off pieces formed by finely cutting a steel wire and discharges the cut-off pieces down into the forming chamber 100 through a conveying channel 210 formed at a side of the bottom.

The forming chamber 100 is disposed under the tank 200, with a side of the top communicating with the conveying channel 210, and a projection side 110 and an impeller 120 are disposed in the forming chamber 100 and round the cut-off pieces dropped through the conveying channel 210.

That is, the tank 20 is a container disposed over the forming chamber 100 including the impeller 120 to collect cut-off pieces and the conveying path 210 for guiding cut-off pieces to be dropped through it is formed at the lower portion of the tank 200. The cut-off pieces are conveyed to the impeller 120 in the forming chamber 100 through the hopper of the impeller 120 connected with the conveying path 210 of the tank 200 and continuously projected to the projection side 110 by rotation of the impeller 120, thereby being rounded.

In detail, the forming chamber, which is a box-shaped part where cut-off pieces are continuously projected, has a first side throughout which the projection side 110 made of chrome steel is formed and a second side where the impeller 120 for strongly guiding air flow to the projection side 110 is disposed.

Figure 2:
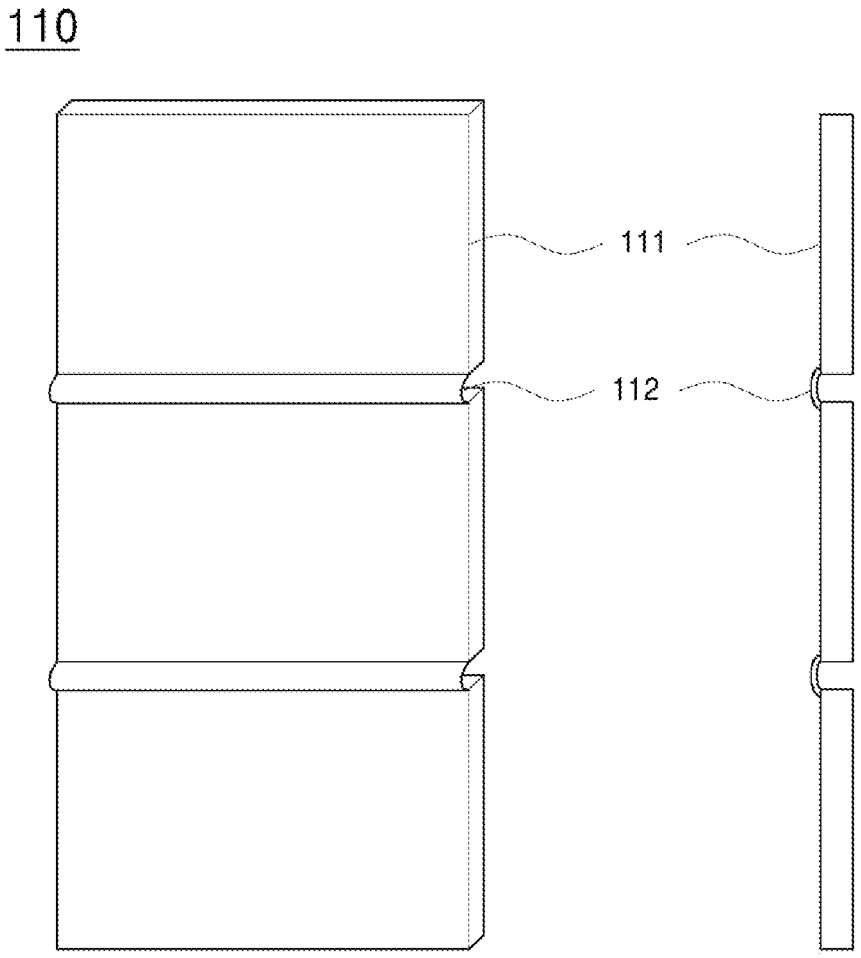
FIG. 2 is a view showing a projection side shown in FIG. 1.

As in FIG. 2 showing the projection side shown in FIG. 1, the projection side 110 is made of chrome steel and composed of a plurality of unit members 111 spaced in the depth direction in the forming chamber 100, and anti-collection plates 112 are disposed between the unit members 111, so the problem that cut-off pieces are collected between the unit members 111 in the related art can be prevented.

The impeller 120, which is a part generating lift by rotating large and wide blades such as a propeller, has a diameter of 360 to 550 mm and the blades are larger than the diameter of the impeller, so the effect of projecting cut-off pieces may be increased.

A space suitable for providing speed energy is defined between the projection side 110 and the impeller 120, so cut-off pieces conveyed to the impeller 120 are continuously projected to the projection side 110 through the impeller 120 by rotation of the impeller 120. Cut-off pieces hitting against the projection side 110 receive shock equal to the kinetic energy generated by their weight and projection speed, so the portions hitting against the projection side 110 are damaged, crushed, or cut off. When a cut-off piece hits against the projection side 110 and the hit portion is an edge of the cut wire, shock is applied for a short time in a narrow area, as compared with other portions that are hit, so shock force is large and the portion is more deformed. Accordingly, the cut-off piece is rounded in a spherical shape by repeating this process.

Next, the conveyer 300 has a first side disposed under the forming chamber 100 and a second side communicating with the top of the tank 200, so it continuously conveys cut-off pieces (hereafter, referred to as "projection pieces" that are dropped after hitting against the projection side 110.

The projection pieces conveyed by the conveyer 300 are continuously and repeatedly projected to the projection side 110, so the more the cut-off pieces are projected, the more the shape of the cut-off pieces becomes close to a real sphere and the higher the fatigue strength, so the portion depressed by hitting is small. Further, the entire surface of the projection pieces receives uniform shock force, so precision is increased.

The dust collector 400 communicates with the forming chamber 110 and absorbs and collects dust and fragments produced in the forming chamber 100. While cut-off pieces hitting against the projection side 110 are formed by breaking due to shock force, fine fragments are separated and dust is continuously produced. Further, the dust causes air pollution when it is exposed to the atmosphere, and causes malfunction by sticking in gaps in the apparatus or deteriorates precision of a forming process by sticking in the hit portions or the depressed portions of the cut-off pieces. Accordingly, the dust collector 400 for absorbing dust in the forming chamber 100 in the process of projection is operated in a cyclone type in order to more effectively suppress generation of dust even under overload in the forming chamber 100.

The collector 400 includes a cyclone unit 410, an inflow pipe 420, a storage 430, and a discharge pipe 440. The cyclone unit 410 has a cylindrical shape with an inverse conical lower portion and allows substances having predetermined weight or more to drop, such as fragments, and discharges dust having predetermined weight or less upward, in the dust flowing inside from above, by generating cyclonic airflow.

The inflow pipe 420 connects the upper portion of the cyclone unit 410 with the forming chamber 110 so that dust and fragments in the forming chamber 100 are absorbed into the cyclone unit 410.

The storage 430 communicates with the bottom of the cyclone unit 410, and stores fragments turning and moving down along the inner side of the cyclone unit 410. The discharge pipe 440 is disposed through the top of the cyclone unit 410, so the dust moved upward in the cyclone unit 410 is discharged.

The vibrator 500, which is provided for sorting projection pieces rounded by hitting (hereafter, referred to as "shot") in accordance with diameters, includes a supply channel 510, a body 520, insertion spaces 530, sorting units 540, discharge ports 550, and a vibrating unit 560.

The supply channel 510 is formed at a second side of the tank 200 and carries shot conveyed in the tank 200 to the body 520.

The body 520 is formed in the shape of a cylinder with the top communicating with the supply channel 510 to provide a space where shot drops.

The insertion spaces 530 are arranged in multiple steps with regular intervals in the depth direction of the body 520. The sorting units 540 are separably inserted in the insertion spaces 530, respectively, in order that dropping cut-off pieces can be sorted in accordance with their diameters.

The discharge ports 550 are disposed between the insertion spaces 530 of the body 520 to discharge sorted cut-off pieces to the outside of the body 520. The discharge ports 550 may be sequentially formed in the depth direction of the body 520 along the outer side of the body 520 to prevent interference with each other.

The vibrating unit 560 is formed at a first side of the body 520 so that the sorting units 540 can sort shots in accordance with diameters by vibrating the sorting units 540.

As a result, according to the vibrator 500, the sorting units 540 in the insertion spaces 530 can sort shot such that shot balls having smaller diameters are sorted, as they goes in the depth direction of the body 520, so it is possible to increase production efficiency by preventing a loss of shot.

The first embodiment of the vibrator 400 of the present invention having the basic configuration described above is described in detail hereafter.

Figure 4:
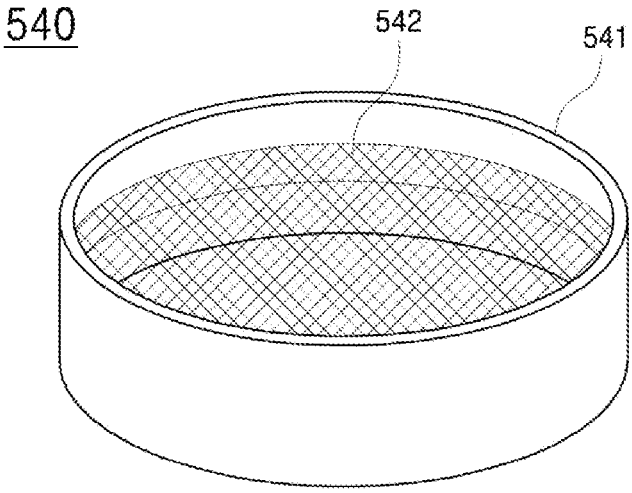
FIG. 4 is a view showing a sorting unit shown in FIG. 3.

As shown in FIG. 4 showing one of the sorting units 540 shown in FIG. 3, the sorting unit 540 has a first rim that is separably inserted in the insertion space 530 and a first filtering net 542 inside the first rim 541.

Further, as shown in FIG. 3, the vibrating unit 560 includes a vibration motor (not shown) disposed under the body 520 and vibrating up/down the body 520 and a plurality of springs 561 disposed on the bottom of the body 520. Accordingly, the vibration motor 520 vibrates up/down the body 520 and the springs 561 largely increase the amplitude, so up-down vibration can be efficiently applied to the sorting units 540.

Figure 5:
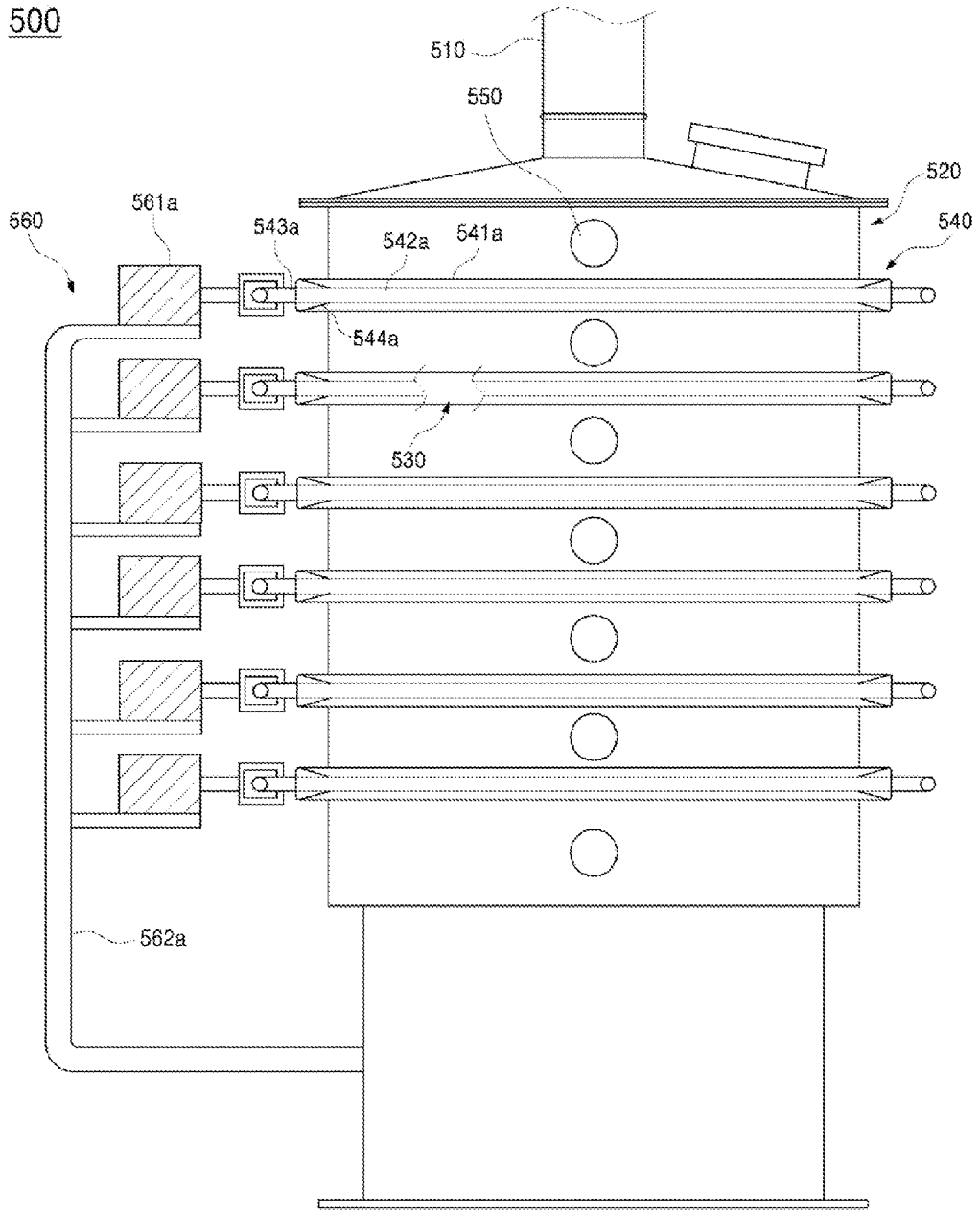
FIG. 5 is a view showing a second embodiment of a vibrator according to the present invention.
Figure 6:
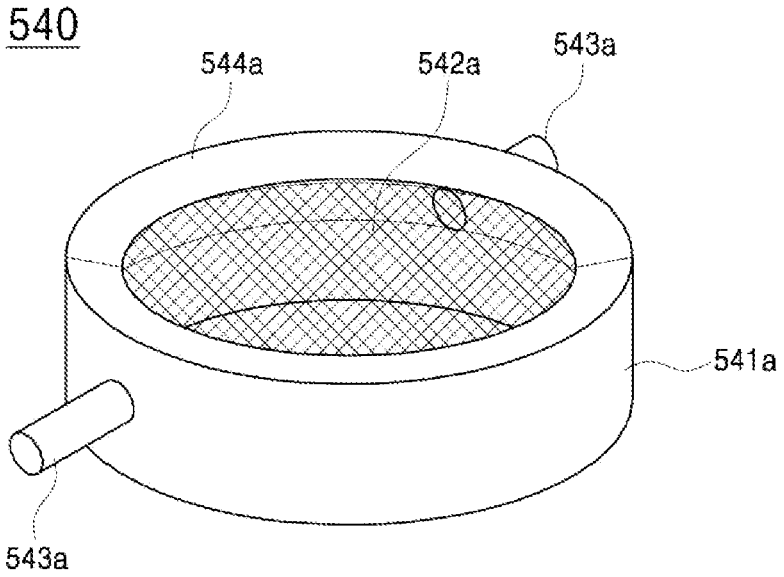
FIG. 6 is a view showing a sorting unit shown in FIG. 5.

The second embodiment of the vibrator 500 according to the present invention is described hereafter in detail with reference to FIG. 5 showing the second embodiment of the vibrator 500 according to the present invention and FIG. 6 shown one of the sorting units 540 shown in FIG. 5, including the previous figures.

The sorting unit 540 includes a second rim 541*a*, a second filtering net 542*a*, rotational shafts 543*a*, and fin stoppers 544*a*.

First, the second rim 541*a* is separably inserted in the insertion space 530 and the second filtering net 542*a* is disposed inside the second rim 541*a*.

The rotational shafts 543*a* are connected to the second filtering net 542*a* through both sides of the second rim 541*a* so that the second filtering net 542*a* can rotate inside the second rim 541*a*.

The fin stoppers 544*a* are made of an elastic material, formed at the upper and lower portions of the second rim 541*a* at an angle toward the center of the second rim 541*a*. Accordingly, the fin stoppers 544*a* limits the rotational angle second filtering net 542*a* rotating about the center of the rotational shafts 543*a*, so it is possible to prevent leakage of shot between the second rim 541*a* and the second filtering net 542*a*.

Further, the vibrating unit 560 includes driving motors 561*a* and a bed 562 and provides rotational vibration to the sorting units 540.

The driving motors are coupled to predetermined rotational shafts 543*a* and repeatedly and finely turn the second filtering net 542*a* forward and backward, so fine rotational vibration is provided to the sorting units 540. The bed 562*a* stably supports the driving motors 561*a* to prevent the driving motors 561*a* from moving due to vibration when they are operated.

As described above, it can be seen that the basic technical spirit of the present invention is to provide an apparatus for forming a shot ball that can prevent a loss of shot in the process of forming and sorting the shot balls and can collect dust in a cyclone type that can strongly suppress generation of dust.

The present invention may be modified in various ways by those skilled in the art without departing from the scope of the present invention and the scope of the present invention should be construed within claims to include various modifications.

What is claimed is:

1. An apparatus for forming a shot ball that includes:

a tank for receiving cut-off pieces finely cut from a steel wire and dropping the cut-off pieces through a conveying channel formed at a side;

a forming chamber disposed under the tank, communicating with the conveying channel, and including a projection side disposed on a first side therein and an impeller rounding cut-off pieces by projecting the cut-off pieces dropping through the conveying channel to the projection side using high-speed airflow;

a conveyer having a first side disposed at a lower portion of the forming chamber and a second side communicating with an upper portion of the tank to convey cut-off pieces, which drop after hitting against the projection side, to the tank; and a dust collector communicating with the forming chamber and collecting dust by absorbing dust and fragments produced in the forming chamber, the apparatus comprising a vibrator that is composed of:

a supply channel formed at a second side of the tank and carrying cut-off pieces that are finished being machined;

a cylindrical body communicating with the supply channel at an upper portion and receiving cut-off pieces that drop;

a plurality of insertion spaces formed with regular intervals in a depth direction of the body;

sorting units separably inserted in the insertion spaces, respectively, and sorting cut-off pieces in accordance with diameters thereof;

discharge ports formed between the insertion spaces to discharge the sorted cut-off pieces; and a vibrating unit disposed at a side of the body and vibrating the sorting units.

2. The apparatus of claim 1, wherein the projection side is made of chrome steel and composed of a plurality of unit members spaced in a depth direction of the first side in the forming body, and anti-collection plates are disposed in spaces between the unit members.

3. The apparatus of claim 1, wherein the dust collector includes:

a cylindrical cyclone unit having an inverse conical lower portion;

an inflow pipe connecting an upper portion of an outer side of the cyclone unit with the forming chamber;

a storage communicating with a bottom of the cyclone unit and storing fragments turning and dropping along an inner side of the cyclone unit; and a discharge pipe communicating with a top of the cyclone unit and discharging dust moved up in the cyclone unit.

4. The apparatus of claim 1, wherein the sorting units each include a first rim separably inserted in a corresponding insertion space and a first filtering net disposed inside the first rim.

5. The apparatus of claim 4, wherein the vibrating unit includes:

a vibration motor disposed under the body and vibrating the body up and down; and a plurality of springs disposed on a bottom of the body.

6. The apparatus of claim 1, wherein the sorting units each include:

a second rim separably inserted in a corresponding insertion space;

a second filtering net disposed inside the second rim;

rotational shafts connected with the second filtering net through both sides of the second rim; and fin stoppers formed at upper and lower portions of the second rim at an angle toward a center of the second rim.

7. The apparatus of claim 6, wherein the vibrating unit includes:

driving motors coupled to predetermined rotational shafts and providing rotational vibration by turning the second filtering net forward and backward; and a bed supporting the driving motors.

* * * * *